US007966667B2

(12) United States Patent
Tomlinson et al.

(10) Patent No.: US 7,966,667 B2
(45) **Date of Patent: *Jun. 28, 2011**

(54) GARMENT WITH UNDERARM EXTERNALLY ACCESSIBLE BREAST POCKETS AND METHOD OF USE

(75) Inventors: Jodi Tomlinson, Ponce Inlet, FL (US); Kevin P. Cutlip, Ponce Inlet, FL (US)

(73) Assignee: GX, Inc., Daytona Beach, FL (US)

( * ) Notice: Subject to any disclaimer, the term of this patent is extended or adjusted under 35 U.S.C. 154(b) by 308 days.

This patent is subject to a terminal disclaimer.

(21) Appl. No.: 12/231,036

(22) Filed: Aug. 29, 2008

(65) Prior Publication Data

US 2009/0172861 A1 Jul. 9, 2009

Related U.S. Application Data

(63) Continuation-in-part of application No. 12/006,951, filed on Jan. 8, 2008, now Pat. No. 7,779,486.

(51) Int. Cl.
*A41B 1/00* (2006.01)
*A41D 13/00* (2006.01)

(52) U.S. Cl. ..... 2/69; 2/108; 2/247

(58) Field of Classification Search ..... 2/69, 69.5, 2/90, 85, 93, 96, 105–108, 247–251, 158–160
See application file for complete search history.

(56) References Cited

U.S. PATENT DOCUMENTS

| | | | | |
|---|---|---|---|---|
| 3,102,270 | A * | 9/1963 | Izzo | 2/96 |
| 3,112,491 | A * | 12/1963 | Cleveland | 2/90 |
| 4,123,804 | A * | 11/1978 | Michael et al. | 2/247 |
| 4,651,348 | A * | 3/1987 | Swanson | 2/93 |
| 4,944,041 | A | 7/1990 | Buenos et al. | |
| 5,072,456 | A | 12/1991 | Elin | |
| 5,953,759 | A | 9/1999 | Bozzini | |
| 6,148,443 | A | 11/2000 | Maastricht | |
| 2007/0000030 | A1 | 1/2007 | Toomey et al. | |
| 2007/0083979 | A1 | 4/2007 | Daniels | |

* cited by examiner

*Primary Examiner* — Gloria Hale
(74) *Attorney, Agent, or Firm* — Paul S. Rooy, PA

(57) ABSTRACT

A garment with underarm externally accessible breast pockets and method of use. An upper body garment is disclosed having garment sleeves attached to a garment trunk, and a pocket mouth disposed under each garment sleeve. A pocket is attached to the garment trunk at each pocket mouth. A passenger positioned behind a driver wearing the upper body garment may insert hands and arms through the pocket mouths and into the pockets for warmth, security, and or intimacy enhancement. Divots sized to accept human fingertips may be attached to the pocket floors for increased security of grip. Alternate embodiment garments include divots sized to accept fingertips on the front outside of a garment or life preserver, and hand indentations sized to accept the palm side of a human hand on the front outside of a garment or life preserver. Methods of use are disclosed.

31 Claims, 10 Drawing Sheets

GARMENT WITH UNDERARM EXTERNALLY ACCESSIBLE BREAST POCKETS AND METHOD OF USE

CLAIM FOR PRIORITY

This utility patent application is a continuation-in-part based upon and claims the benefit of the earlier filing date of U.S. patent application Ser. No. 12/006,951 filed Jan. 8, 2008 now U.S. Pat. No. 7,779,486 entitled Garment With Underarm Externally Accessible Breast Pockets and Method of Use.

BACKGROUND OF THE INVENTION

1. Field of the Invention

This invention relates to upper body garments, and in particular to a garment with underarm externally accessible breast pockets and method of use.

2. Background of the Invention

An on-going challenge inherent in tandem riding in vehicles such as motorcycles, motor scooters, motorized tricycles, jet skis, sleds, etc., is keeping the rear passenger securely in the rear seat. The vehicle driver has the handlebars to hold on to; the rear passenger frequently has only the driver.

In addition, riding these types of vehicles can be a cold and breezy endeavor. Thus, it would be desirable to provide the vehicle passenger a warm place to put his or her hands while holding on to the driver for support.

Finally, holding on to a vehicle driver garbed in a leather jacket can be a rather cold and impersonal experience, due to the thickness of the jacket or other upper body garment. Therefore, it would be desirable to provide an upper body garment which provides interior pockets accessible from the outside, to act as in intimacy enhancer between the driver and the rear passenger.

Existing Designs

Numerous designs for rear vehicle racks (such as motorcycle luggage racks) are available on the market. The rear passenger may grasp these for support, but this procedure typically doesn't work as well as simply holding on to the driver. In addition, the racks currently available do not keep the rear passenger's hands warm, nor do they enhance the intimacy between the driver and the passenger.

Thus, it would be desirable to provide an upper body garment with underarm externally accessible breast pockets and method of use, which securely supports the rear passenger, warms the rear passenger's hands, and enhances intimacy between the vehicle driver and the passenger.

SUMMARY OF THE INVENTION

Accordingly, it is an object of the present invention to provide a garment with underarm externally accessible breast pockets and method of use which helps keep a passenger securely seated on the vehicle rear seat. As used in this disclosure, the term vehicle is intended to refer to any vehicle wherein at least one passenger is seated behind a driver, including but not limited to motorcycles, scooters, motorized tricycles, jet skis, sleds, etc. Design features allowing this object to be accomplished include an upper body garment worn by the vehicle driver which has externally accessible breast pockets, divots sized to admit passenger fingertips, and/or hand indentations. An advantage associated with the accomplishment of this object is increased vehicle passenger security.

It is another object of the present invention to provide a garment with underarm externally accessible breast pockets and method of use which helps keep the rear vehicle passenger's hands and arms warm. Design features allowing this object to be accomplished include an upper body garment worn by the vehicle driver which has externally accessible breast pockets. A benefit associated with the accomplishment of this object is increased passenger comfort achieved by inserting the hands and arms of the passenger into the pockets within an upper body garment, and sharing the body warmth of the driver.

It is still another object of the present invention to provide a garment with underarm externally accessible breast pockets and method of use which enhances intimacy between a vehicle driver and a vehicle passenger. Design features allowing this object to be accomplished include an upper body garment worn by the vehicle driver which has externally accessible breast pockets, and which permit the passenger to introduce his or her hands through the outer fabric of an upper body garment worn by the driver. An advantages associated with the accomplishment of this object is increased closeness between the vehicle driver and the vehicle passenger.

It is yet another object of this invention to provide a garment with underarm externally accessible breast pockets and method of use which is inexpensive to produce. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Ten sheets of drawings are provided. Sheet one contains FIGS. 1 and 2. Sheet two contains FIGS. 3 and 4. Sheet three contains FIGS. 5 and 6. Sheet four contains FIGS. 7 and 8. Sheet five contains FIGS. 9 and 10. Sheet six contains FIGS. 11 and 12. Sheet seven contains FIGS. 13 and 14. Sheet eight contains FIGS. 15 and 16. Sheet nine contains FIGS. 17 and 18. Sheet ten contains FIG. 19.

DETAILED DESCRIPTION OF THE PREFERRED EMBODIMENT

Figure 3:
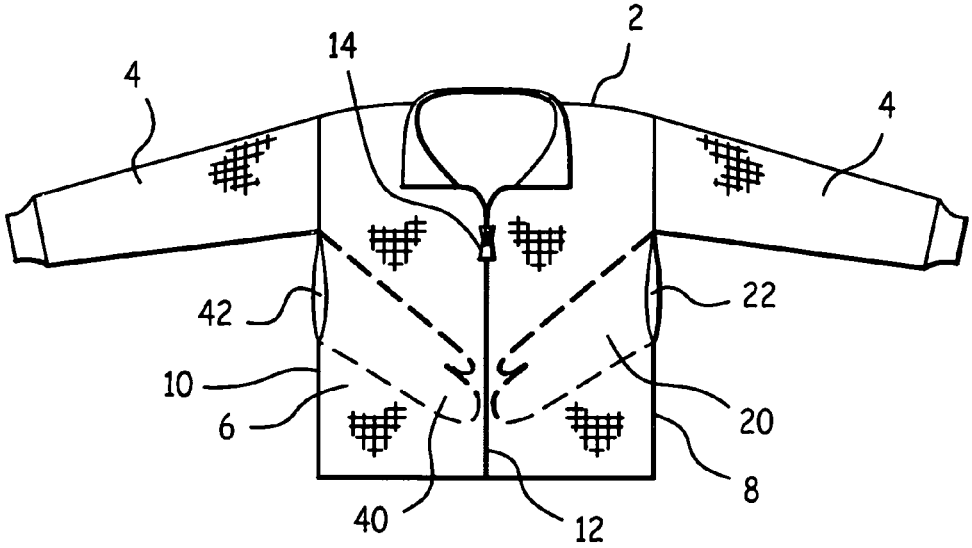
FIG. 3 is a front view of a garment with underarm externally accessible breast pockets, with the pockets depicted in dashed lines.

Referring now to FIG. 3 we observe a front view of upper body garment 2 having sleeves 4, garment trunk 6, garment front opening 12, and garment zipper 14, which serves to close garment front opening 12 in conventional fashion. The side edges of garment trunk 6 are garment left side 8 which extends downwardly from the intersection of left garment sleeve 4 with garment trunk 6, and garment right side 10 which extends downwardly from the intersection of right garment sleeve 4 with garment trunk 6.

Figure 4:
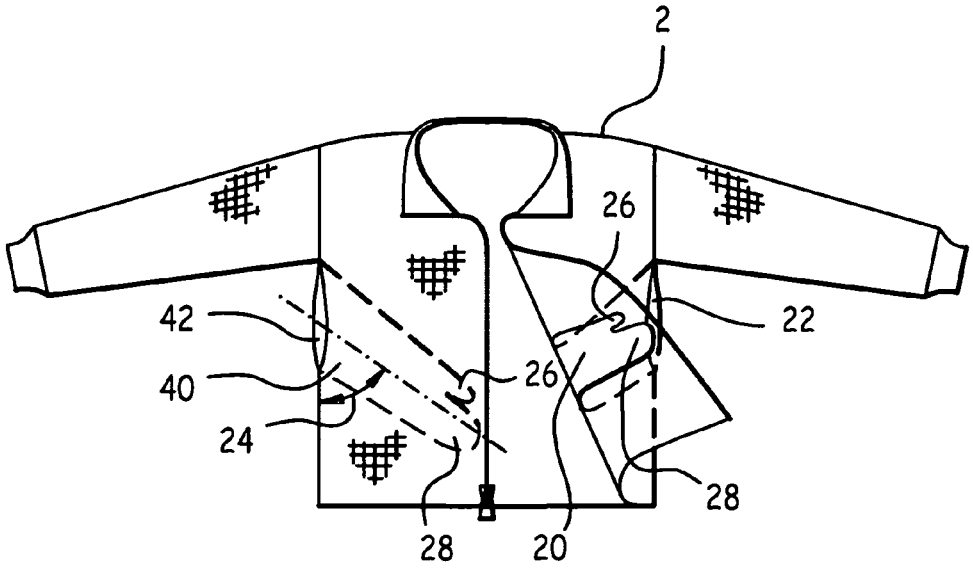
FIG. 4 is a front view of a garment with underarm externally accessible breast pockets, with its left side open.

FIG. 4 is a front view of upper body garment 2 with the left side of garment trunk 6 open, showing the internal placement of left pocket 20.

Garment 2 incorporates left pocket 20 which communicates with an exterior of upper body garment 2 through left pocket mouth 22, and right pocket 40 which communicates with an exterior of upper body garment 2 through right pocket mouth 42. Left pocket 20 and right pocket 40 are depicted in dashed lines.

Left pocket mouth 22 is disposed along garment left side 8, extending downwardly directly below the intersection of left garment sleeve 4 with garment trunk 6. Right pocket mouth 42 is disposed along garment right side 10, extending downwardly from the intersection of right garment sleeve 4 with garment trunk 6.

Left pocket mouth 22 and left pocket 20 are sized to admit the hand and arm of a passenger, so that a passenger is able to insert his or her arm through left pocket mouth 22 and into left pocket 20 of an upper body garment 2 worn by the driver, for security, warmth, and/or intimacy enhancement. Similarly, right pocket mouth 42 and right pocket 40 are sized to admit the hand and arm of a passenger, so that a passenger is able to insert his or her arm through right pocket mouth 42 and into right pocket 40 of an upper body garment 2 worn by the driver, for security, warmth, and/or intimacy enhancement.

While in the preferred embodiment the end of pockets 20, 40 extended substantially to garment front opening 12, it is intended to fall within the scope of this disclosure that pockets 20, 40 may be any appropriate length.

Figure 1:
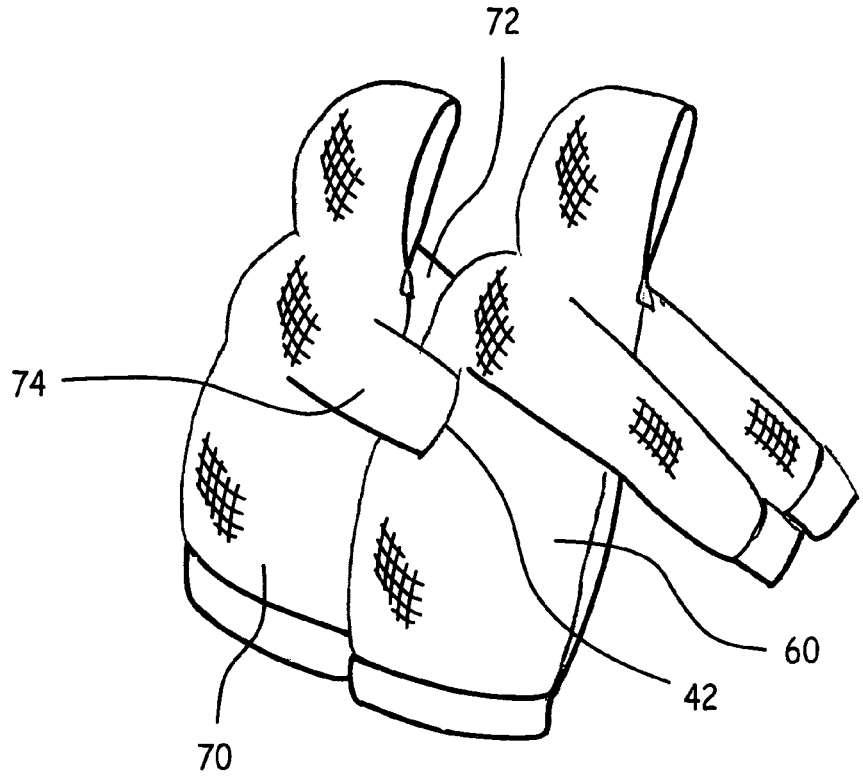
FIG. 1 is a side view of a driver and a passenger; the driver is wearing a garment with underarm externally accessible breast pockets and the passenger has his or her arms inserted into the underarm pockets for security, warmth, and/or intimacy enhancement.

FIG. 1 is a side view of a passenger 70 riding on a vehicle behind a driver 60. The driver is wearing a garment with underarm externally accessible breast pockets, which comprises upper body garment 2 having left pocket 20 which communicates with the exterior of upper body garment 2 through left pocket mouth 22, and right pocket 40 which communicates with the exterior of upper body garment 2 through right pocket mouth 42.

Passenger 70 has passenger right arm 74 inserted through right pocket mouth 42 and into right pocket 40, and passenger left arm 72 inserted through left pocket mouth 22 and into left pocket 20. Thus, passenger 70 has both passenger arms 72, 74 inserted into corresponding pockets 20, 40 in upper body garment 2 worn by driver 60, for security, warmth, and/or intimacy enhancement.

Figure 2:
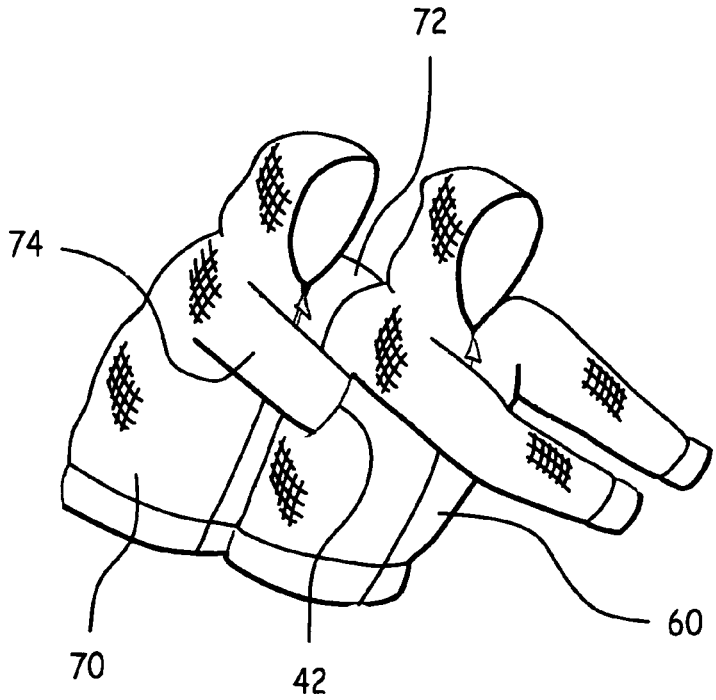
FIG. 2 is a front quarter isometric view of a driver and a passenger; the driver is wearing a garment with underarm externally accessible breast pockets and the passenger has his or her arms inserted into the underarm pockets for security, warmth, and/or intimacy enhancement.

FIG. 2 is a front quarter isometric view of a driver 60 and a passenger 70. The driver is wearing upper body garment 2 having left pocket 20 which communicates with the exterior of upper body garment 2 through left pocket mouth 22, and right pocket 40 which communicates with the exterior of upper body garment 2 through right pocket mouth 42. Passenger 70 has passenger right arm 74 inserted through right pocket mouth 42 and into right pocket 40, and passenger left arm 74 inserted through left pocket mouth 22 and into left pocket 20. Thus, as depicted in FIG. 2 passenger 70 has both passenger arms 72, 74 inserted into corresponding pockets 20, 40 in upper body garment 2 worn by driver 60, for security, warmth, and/or intimacy enhancement.

In the embodiment garment with underarm externally accessible breast pockets depicted in FIGS. 3 and 4, left pocket 20 and right pocket 40 each terminate in a mitten shape having thumb lobe 26 and major lobe 28. Thumb lobe 26 is sized to admit a passenger 70 thumb; major lobe 28 is sized to admit passenger 70 fingers.

In the embodiment garment with underarm externally accessible breast pockets depicted in FIGS. 3 and 4, left pocket 20 and right pocket 40 extend downwardly from garment left side 8 and garment right side 10 respectively at a pocket angle 24 substantially equal to 40 degrees±20 degrees. Many vehicles feature elevated rear seats, so this pocket angle 24 was experimentally determined to be optimal for some such seating configurations. In addition, where a driver 60 is not (and/or does not wish to become) intimately familiar with a passenger 70, a pocket angle 24 substantially equal to 40 degrees±20 degrees avoids placing the hands of passenger 70 directly on the breasts of driver 60.

In the embodiment depicted in FIG. 4 pocket angle 24 is fixed, by adhering pockets 20, 40 to the inside of garment trunk 6, by stitching, adhesive, or any other appropriate adhesion means. It is intended to fall within the scope of this disclosure, however, that pockets 20, 40 may be attached to upper body garment 2 solely at their respective pocket mouths 22, 42, leaving the rest of pockets 20, 40 free-floating within upper body garment 2. In this embodiment, passenger 70 may place his or her arms within pockets 20, 40 at any angle comfortable to, or desired by, passenger 70 and/or driver 60.

Figure 5:
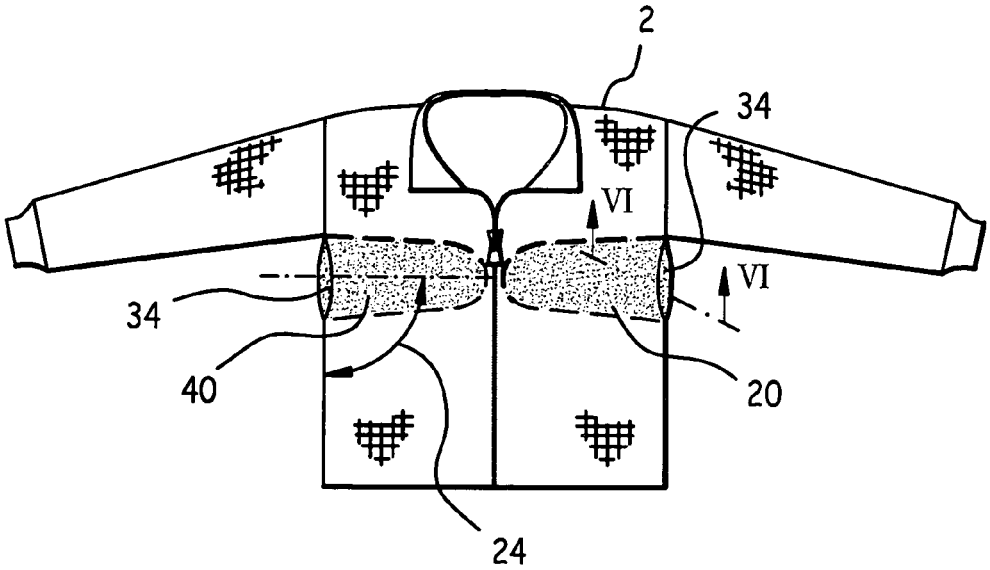
FIG. 5 is a front view of an alternate embodiment garment with underarm externally accessible breast pockets having a pocket angle of 90 degrees±20 degrees, and non-slip material lining the pocket floors.

FIG. 5 is a front view of an alternate embodiment garment with underarm externally accessible breast pockets having a pocket angle 24 of 90 degrees i 20 degrees, and non-slip material 34 lining pocket floors 32.

Figure 6:
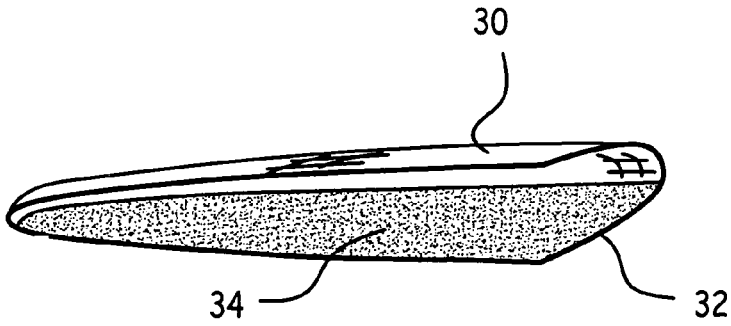
FIG. 6 is a side cross-sectional view of a pocket having non-slip material lining its pocket floor.

FIG. 6 is a side cross-sectional view of a pocket 20 or 40 having non-slip material 34 lining its pocket floor 32, taken at section VI-VI of FIG. 5. As may be observed in FIG. 6, pockets 20, 40 each comprise pocket roof 30 adjacent garment trunk 6, and pocket floor 32 opposite pocket roof 30. Non-slip material may be attached to floor 32 and/or pocket roof 30, to increase the security of the grip of the hands and arms of passenger 70 within pockets 20, 40. While non-slip material 34 may increase the security of the grip of passenger 70 on driver 60, it may also decrease the potential for intimacy enhancement by adding another layer of material between passenger 70 and driver 60.

In the preferred embodiment non-slip material 34 was rubberized fabric, rough-textured fabric, rubber coating, or any other appropriate non-slip material.

Figure 7:
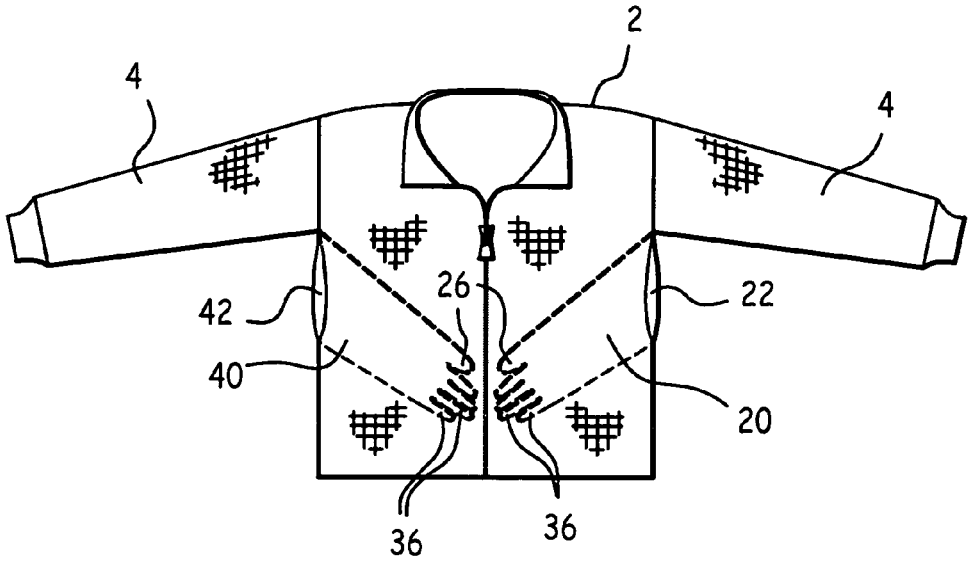
FIG. 7 is a is a front view of an alternate embodiment garment with underarm externally accessible breast pockets wherein the pockets terminate in a thumb lobe and a plurality of finger lobes.

FIG. 7 is a is a front view of an alternate embodiment garment with underarm externally accessible breast pockets wherein pockets 20, 40 terminate in a glove shape comprising thumb lobe 26 and a plurality of finger lobes 36. Typically the embodiment shown in FIG. 7 would comprise a single thumb lobe 26 and four finger lobes 36 per pocket 20, 40.

In the embodiment illustrated in FIGS. 5 and 6, pockets 20, 40 terminate in a simple closed end, as opposed to the mitten shape and glove shape pocket termination disclosed in FIGS. 3, 4 and 7 respectively. In the mitten shape termination of pockets 20, 40 illustrated in FIGS. 3 and 4, passenger 70 may increase the security of his or her grip within pockets 20, 40 by gripping thumb lobe 26 and major lobe 28 between the passenger's thumb and fingers. Similarly, in the glove shape termination of pockets 20, 40 illustrated in FIG. 7, passenger 70 may increase the security of his or her grip within pockets 20, 40 by gripping thumb lobe 26 and finger lobes 36 between the passenger's thumb and fingers.

Figure 8:
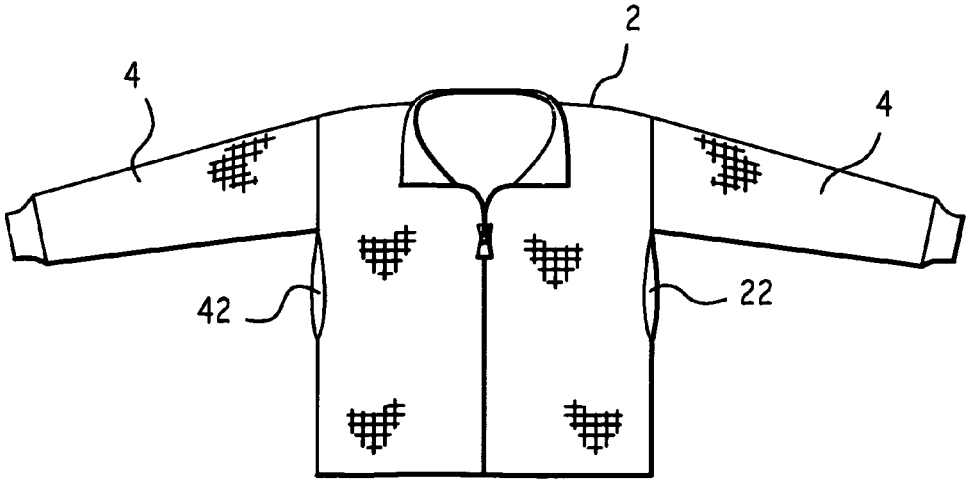
FIG. 8 is a is a front view of an alternate embodiment garment with underarm externally accessible breast pockets which comprises pocket mouths below the garment sleeves, and the garment itself serves as the pockets.

FIG. 8 is a front view of an alternate embodiment garment with underarm externally accessible breast pockets which comprises pocket mouths 22, 42 below the garment sleeves 4, and the garment itself serves as the pockets. In this embodiment passenger 70 introduces hands and arms through pocket mouths 22, 42, and grips driver 60 in conventional fashion, and upper body garment 2 plus the body warmth of the driver serve to keep the hands and arms of passenger 70 warm.

It should be noted that the different embodiments taught in this disclosure may achieve different purposes. Where a driver 60 is not (and/or does not wish to become) intimately familiar with a passenger 70, a pocket angle 24 substantially equal to 40 degrees±20 degrees avoids placing the hands of passenger 70 directly on the breasts of driver 60, as depicted in FIGS. 3 and 4.

Conversely, where a driver 60 is (or wishes to become) intimately familiar with a passenger 70, a pocket angle 24 substantially equal to 90 degrees±20 degrees places the hands of passenger 70 directly on the breasts of driver 60. In this embodiment, an offer of a motorcycle ride may actually constitute an invitation to greater intimacy, because as soon as passenger 70 is directed by driver 60 to place his or her hands and arms within pockets 20, 40 having a pocket angle 24 substantially equal to 90 degrees±20 degrees, passenger 70 finds his or her arms directly over the breasts of driver 60.

Similarly, where a driver 60 is (or wishes to become) intimately familiar with a passenger 70, the embodiment described above wherein pockets 20, 40 are attached to upper garment body 2 only at their respective mouths 22, 42, leaving the rest of pockets 20, 40 free-floating within upper body garment 2, may be appropriate. In this embodiment, passenger 70 may place his or her arms within pockets 20, 40 at any angle comfortable to, or desired by, passenger 70 and/or driver 60.

A similar effect is also achieved by the embodiment of FIG. 8, wherein upper body garment 2 itself is the pocket, and passenger 70 inserts his or her arms through left pocket mouth 22 and right pocket mouth 42 directly into the inside of upper body garment 2 worn by driver 60. In this embodiment, passenger 70 may place his or her arms at any angle comfortable to, or desired by, passenger 70 and/or driver 60, un-encumbered by pockets 20, 40. As in the 90±20 degrees pocket angle embodiment, in this embodiment, an offer of a motorcycle ride may actually constitute an invitation to greater intimacy, because as soon as passenger 70 is directed to place his or her hands and arms through pocket mouths 22, 42 passenger 70 finds his or her hands and arms free to position anywhere on the front torso of driver 60 comfortable to, or desired, by passenger 70 and/or driver 60. As in the free-floating pocket embodiment, the invitation to intimacy is not as explicit as in the 90±20 degrees pocket angle embodiment, where the hands of passenger 70 are channeled directly over the breasts of driver 60 by pockets 20, 40.

A trade-off for the increased intimacy enhancement potential of the free-floating pocket embodiment and the embodiment wherein upper body garment 2 itself is the pocket, may be decreased security of the grip of passenger 70 on driver 60. In addition, if pockets 20, 40 are lined with non-slip material, the tactile sensitivity between driver 60 and passenger 70 may be decreased, thus decreasing the potential for intimacy enhancement.

Accordingly, the instant method of use comprises the steps of:

A. Providing an upper body garment having a left garment sleeve and a right garment sleeve extending from a garment trunk, a garment left side extending downwardly from an intersection of said left garment sleeve with said garment trunk, a garment right side extending downwardly from an intersection of said right garment sleeve with said garment trunk, at least one pocket communicating with an exterior of said garment through a pocket mouth, said pocket mouth being disposed along one said garment side directly below one said garment sleeve;

B. A driver donning said upper body garment;

C. Positioning a passenger behind said driver; and

D. Said passenger inserting at least one passenger arm through said pocket mouth into said at least one pocket.

The instant method of use may comprise the further step of providing a mitten shape termination comprising a thumb lobe and a major lobe for each said at least one pocket, and said passenger gripping said thumb lobe and said major lobe between a passenger thumb and passenger fingers.

The instant method of use may comprise the further step of providing a glove shape termination comprising a thumb lobe and a plurality of finger lobes for each said at least one pocket, and said passenger gripping said thumb lobe and said finger lobes between a passenger thumb and passenger fingers.

The instant method of use may comprise the further step of providing non-slip material attached to an inside of each said at least one pocket, and said passenger gripping said non-slip material for increased passenger security.

The instant method of use may comprise the further steps of providing said at least one pocket at a pocket angle of substantially 90 degrees±20 degrees relative to said garment side where said pocket mouth is disposed, and channeling said passenger's hand through said pocket mouth, into said pocket, and directly over at least one breast of said driver.

The instant method of use may comprise the further steps of providing said at least one pocket at a pocket angle of substantially 40 degrees±20 degrees relative to said garment side where said pocket mouth is disposed, and channeling said passenger's hand through said pocket mouth, into said pocket, and away from a breast of said driver.

In the preferred embodiment, upper garment 2 and pockets 20, 40 were made of fabric, leather, synthetic, or any other appropriate material. Non-slip material 34 was rubberized fabric, rough-textured fabric, rubber coating, or any other appropriate non-slip material.

FIGS. 9-15 depict alternate embodiment upper body garments 2 incorporating divots 82, which serve to help a rider maintain a good grip on upper body garment 2. FIGS. 16-19 depict alternate embodiment upper body garments 2 incorporating hand indentations 108, which serve to help a rider maintain a good grip on upper body garment 2.

Figure 9:
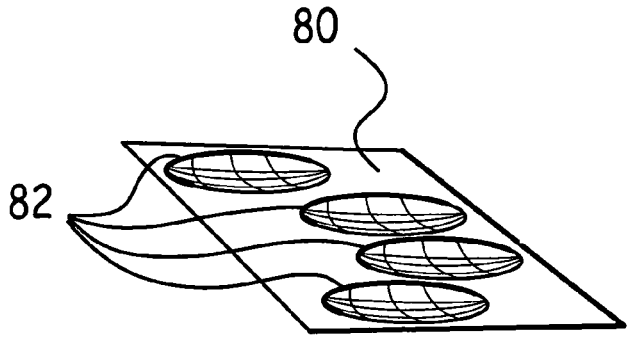
FIG. 9 is an elevated side isometric view of a divot sheet containing four divots, one for each finger.
Figure 10:
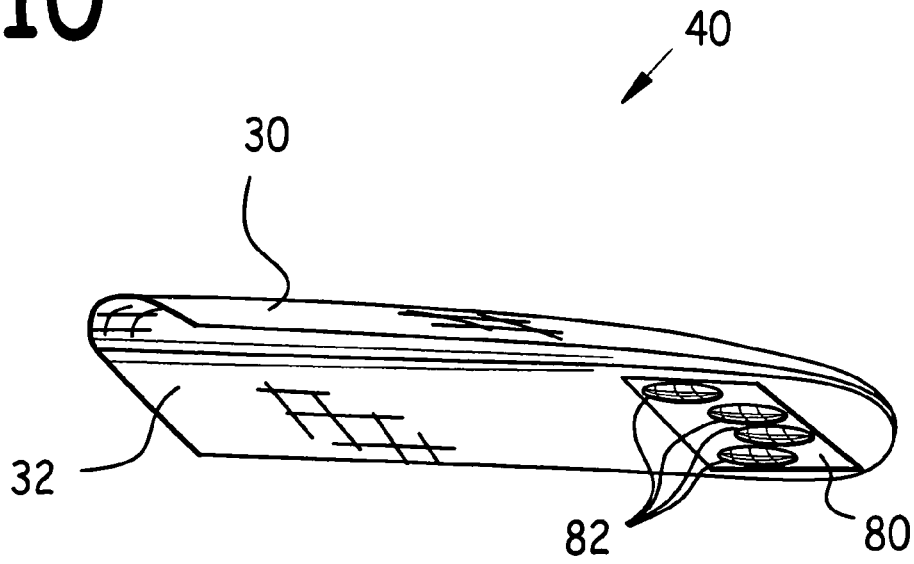
FIG. 10 is a side cross-sectional view of a pocket having a divot sheet with four divots attached to its pocket floor.

FIG. 9 is an elevated side isometric view of divot sheet 80 containing four divots 82, one for each finger. Each divot 82 is a concave indentation which is sized, shaped and located so as to admit the distal end of a human finger. FIG. 10 is a side cross-sectional view of right pocket having divot sheet 80 with four divots 82 attached to its pocket floor 32. A passenger 70 may put his hands into right pocket 40 as previously described, and place the distal ends of each finger into a respective divot 82. With fingertips securely placed within divots 82, passenger 70 enjoys a more secure grip on right pocket 40, and by extension, a more secure grip on driver 60. While the embodiment depicted in FIG. 10 shows divots 82 integral to divot sheet 80 and divot sheet 80 attached to pocket floor 32, it is intended to fall within the scope of this disclosure that divots may be separate, individual components, individually attached to pocket floor 32.

Figure 11:
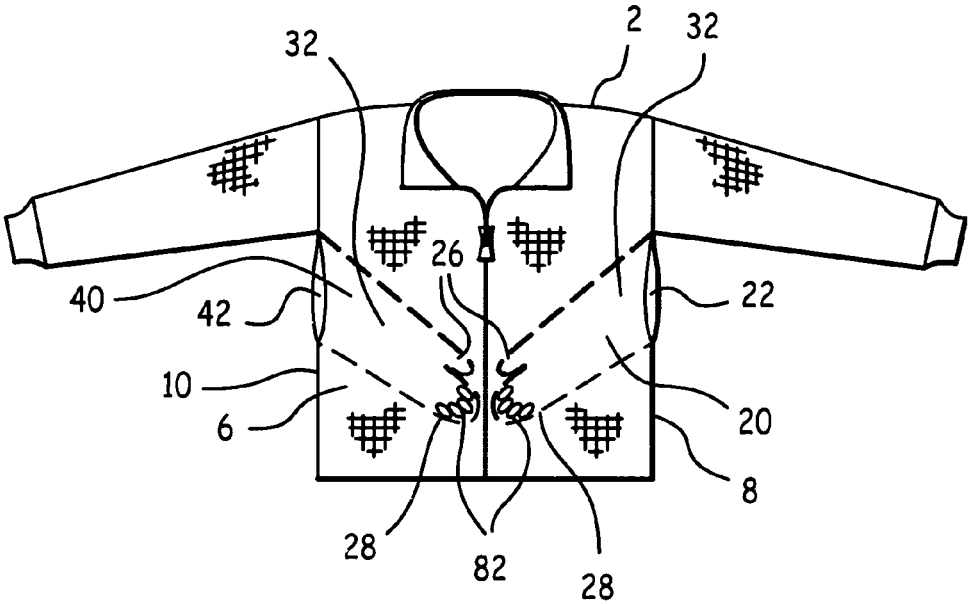
FIG. 11 is a front view of an alternate embodiment upper body garment with underarm externally accessible breast pockets wherein the pockets terminate in a thumb lobe and a major lobe, and wherein a divot corresponding to each passenger fingertip is attached to the pocket floor of the major lobe.

FIG. 11 is a front view of an alternate embodiment upper body garment 2 with underarm externally accessible breast pockets wherein the pockets 20, 40 each terminate in a thumb lobe and a major lobe 28, and wherein a divot 82 corresponding to each passenger 70 fingertip is attached to the pocket floor 32 of each major lobe 28. With fingertips securely placed within divots 82, passenger 70 enjoys a more secure grip on pockets 20, 40, and by extension, a more secure grip on driver 60. As previously mentioned, divots 82 may be integral to divot sheet 80 and divot sheet 80 is attached to pocket floor 32, or alternatively divots 82 may be separate, individual components, individually attached to pocket floor 32.

Figure 12:
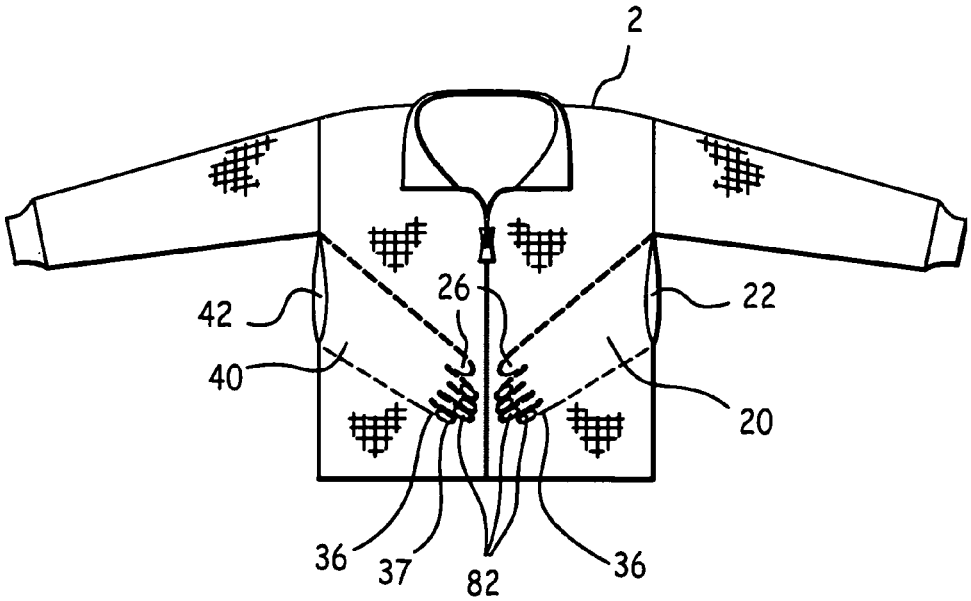
FIG. 12 is a front view of an alternate embodiment upper body garment with underarm externally accessible breast pockets wherein the pockets terminate in a thumb lobe and a plurality of finger lobes, and a divot is attached to the pocket floor at the distal end of each finger lobe.

FIG. 12 is a front view of an alternate embodiment upper body garment 2 with underarm externally accessible breast pockets wherein the pockets 20, 40 each terminate in a thumb lobe and a plurality of finger lobes 36, and a divot 82 is attached to the pocket floor 32 at each finger lobe distal end 37. In this embodiment divots 82 are separate, individual components, individually attached to pocket floor 32.

Figure 13:
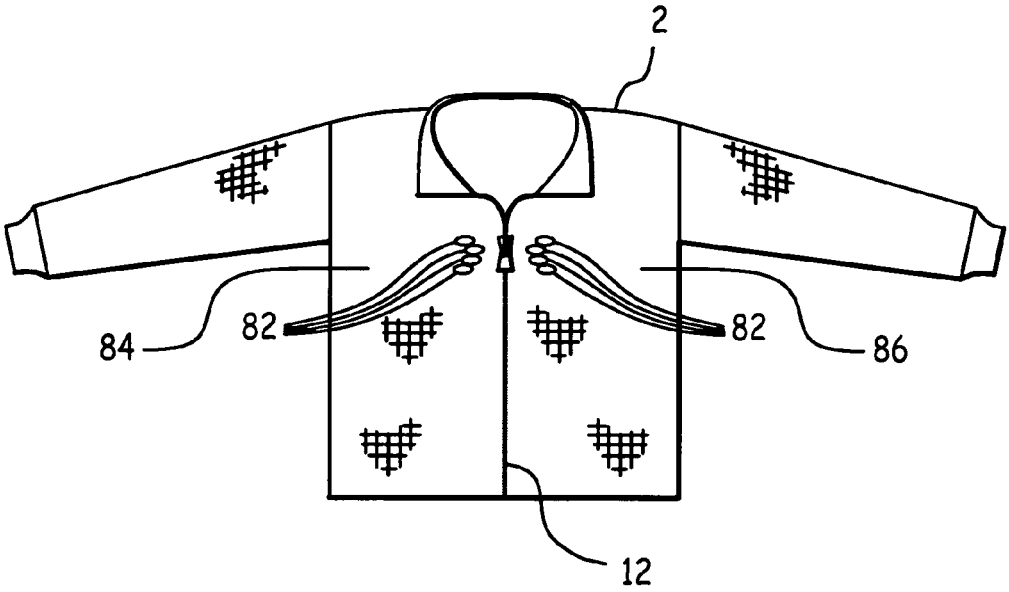
FIG. 13 is a front view of an alternate embodiment upper body garment having divots installed on its garment left chest and garment right chest adjacent the garment front opening.

FIG. 13 is a front view of an alternate embodiment upper body garment 2 having divots 82 installed on its garment left chest 86 and its garment right chest 84 adjacent garment front opening 12. A passenger 70 may simply put his arms around the chest of driver 60 in conventional fashion, insert his fingertips into divots 82, and thus enjoy a more secure grip on the chest of driver 60.

Figure 14:
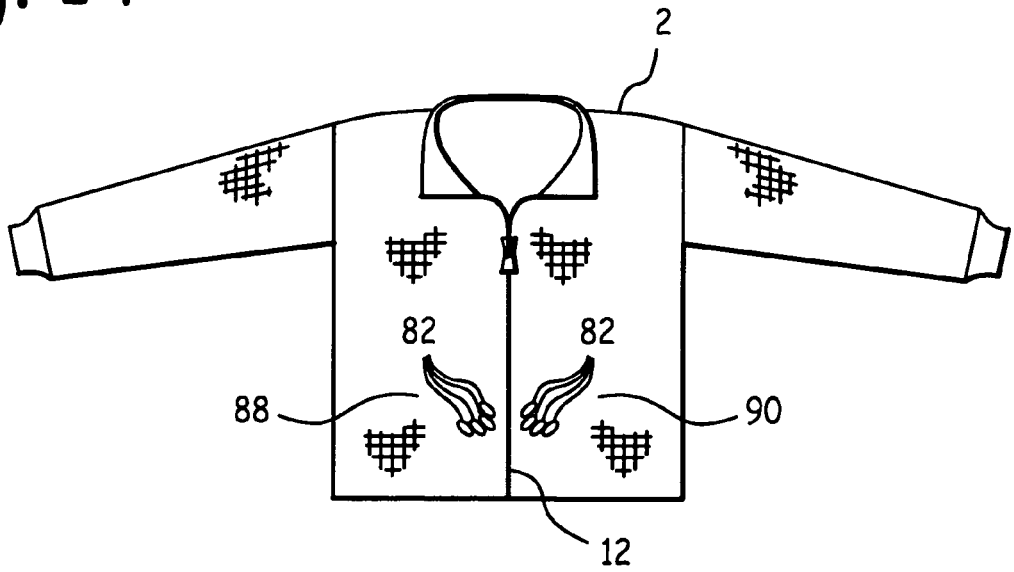
FIG. 14 is a front view of an alternate embodiment upper body garment having divots installed on its garment left stomach and garment right stomach adjacent the garment front opening.

FIG. 14 is a front view of an alternate embodiment upper body garment 2 having divots 82 installed on its garment left stomach 90 and its garment right stomach 88 adjacent garment front opening 12. A passenger 70 may simply put his arms around the stomach of driver 60 in conventional fashion, insert his fingertips into divots 82, and thus enjoy a more secure grip on driver 60.

Figure 15:
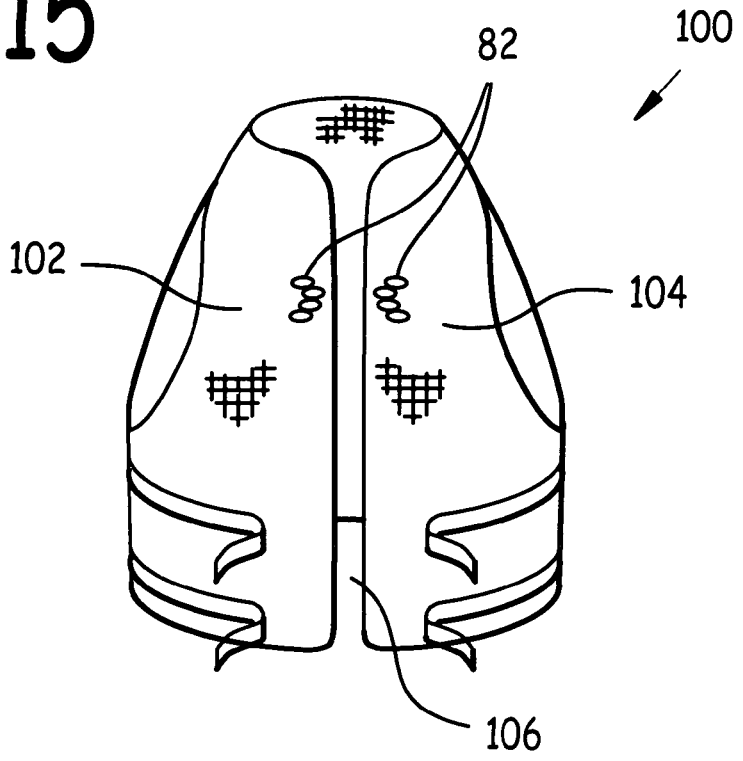
FIG. 15 is a front view of a life preserver with divots molded into its life preserver left chest and life preserver right chest adjacent the life preserver front opening.

FIG. 15 is a front view of life preserver 100 with divots 82 molded into its life preserver left front 104 and life preserver right front 102 adjacent life preserver front opening 106. Many life preservers 100 are manufactured of foam material, into which divots 82 may be readily molded. A passenger 70 may simply put his arms around the driver 60 in conventional fashion, insert his fingertips into divots 82, and thus enjoy a more secure grip on the driver 60. It is intended to fall within the scope of this disclosure that divots 82 may be positioned anywhere on life preserver left front 104 and life preserver right front 102, as desired—in the chest area, the stomach area, or any appropriate and/or desired location on life preserver left front 104 and life preserver right front 102.

In the embodiments depicted in FIGS. 9-15, divots 82 were concave indentations which were sized, shaped and located so as to admit the distal end of a human finger (the fingertip), and grouped in groups of four: one divot 82 corresponding to each human fingertip. In addition, the divots were sized, shaped and located so as to admit the distal end of a human finger, that is, located in the resting position that human fingertips would be in if rested against upper body garment 2, pocket floor 32, or the front of life preserver 100.

Figure 16:
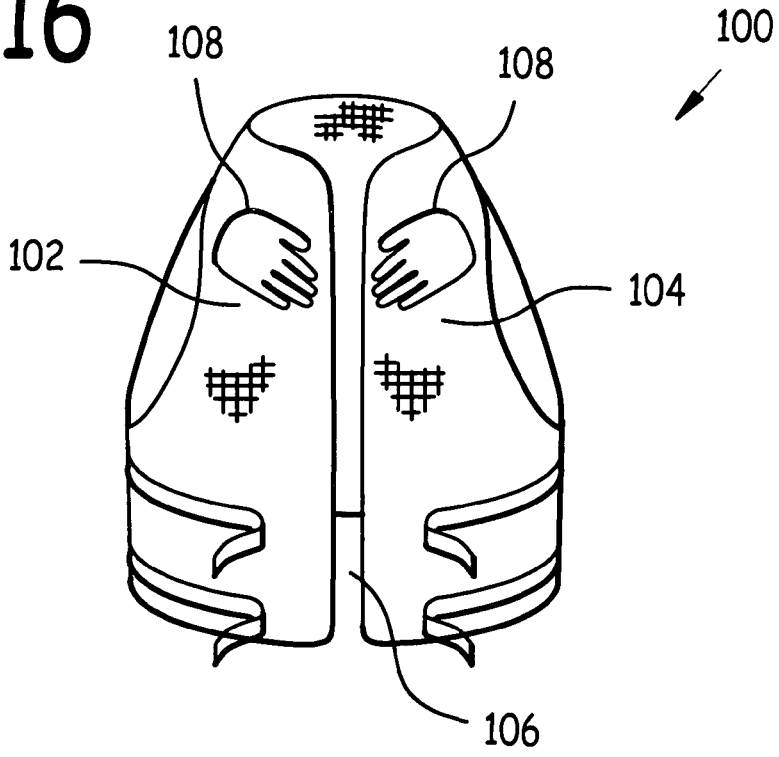
FIG. 16 is a front view of a life preserver with a hand indentation molded into its life preserver right front, and a hand indentation molded into its life preserver left front, adjacent the life preserver front opening.

FIG. 16 is a front view of life preserver 100 with a hand indentation 108 molded into its life preserver right front 102, and a hand indentation 108 molded into its life preserver left front 104 adjacent life preserver front opening 106. Many life preservers 100 are manufactured of foam material, into which hand indentations 108 may be readily molded. Hand indentations 108 are sized, shaped and located so as to admit the palm side of a human hand. A passenger 70 may simply put his arms around the driver 60 in conventional fashion and insert his hands into hand indentations 108, and thus enjoy a more secure grip on life preserver 100, and by extension on driver 60.

Figure 17:
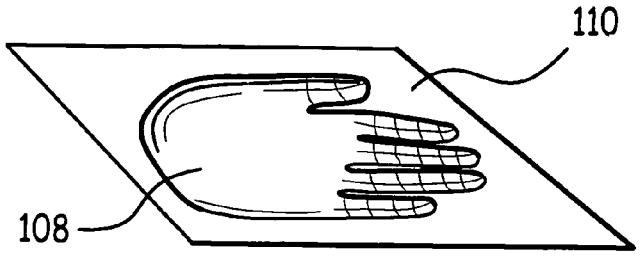
FIG. 17 is a front elevated view of a hand indentation sheet having a hand indentation.
Figure 18:
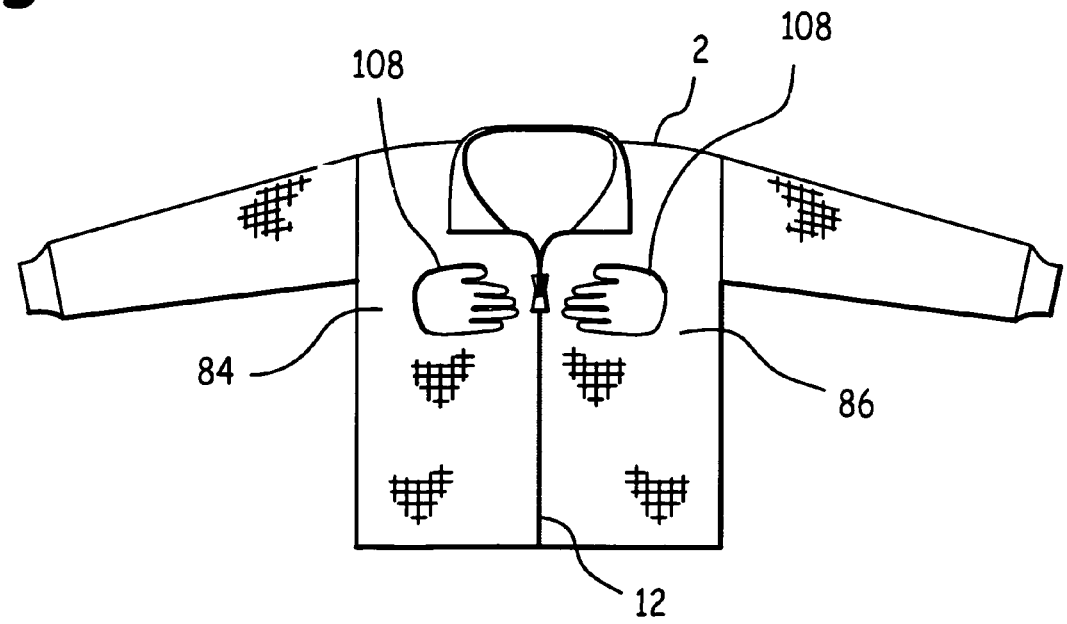
FIG. 18 is a front view of an upper body garment with a hand indentation installed on its garment right chest adjacent the garment front opening, and a hand indentation installed on its left chest adjacent the garment front opening.

FIG. 17 is a front elevated view of hand indentation sheet 110 having an integral hand indentation 108. FIG. 18 is a front view of upper body garment 2 with a hand indentation 108 installed on its garment right chest 84 adjacent garment front opening 12, and a hand indentation 108 installed on its garment left chest 86 adjacent garment front opening 12 A passenger 70 may put his hands around the chest of driver 60 in conventional fashion, and then place the palm side of his hands into respective hand indentations 108. With hands securely placed within hand indentations 108, passenger 70 enjoys a more secure grip on garment right chest 84 and garment left chest 86, and by extension, a more secure grip on driver 60. While the embodiment depicted in FIG. 17 shows hand indentation 108 integral to hand indentation sheet 110, it is intended to fall within the scope of this disclosure that hand indentations 108 may be separate, individual components, individually attached to garment right chest 84 and garment left chest 86.

Figure 19:
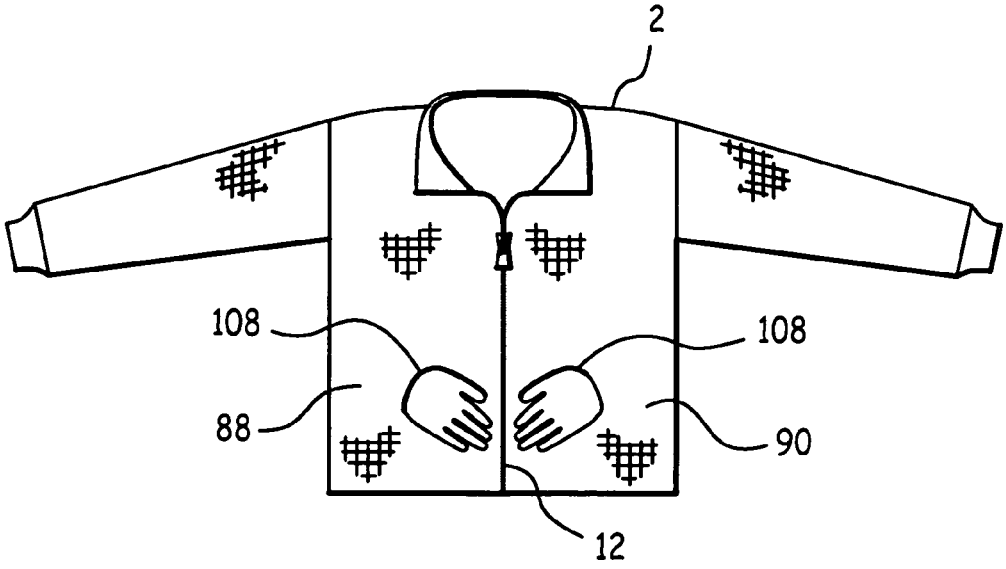
FIG. 19 is a front view of an upper body garment with a hand indentation installed on its garment right stomach adjacent the garment front opening, and a hand indentation installed on its left stomach adjacent the garment front opening.

FIG. 19 is a front view of upper body garment 2 with a hand indentation 108 installed on its garment right chest 84 adjacent garment front opening 12, and a hand indentation 108 installed on its garment left chest 86 adjacent garment front opening 12, with its digits pointing towards garment front opening 12. A passenger 70 may put his hands around the chest of driver 60 in conventional fashion, and then place the palm side of his hands into respective hand indentations 108. With hands securely placed within hand indentations 108, passenger 70 enjoys a more secure grip on garment right chest 88 and garment left chest 90, and by extension, a more secure grip on driver 60. While the embodiment depicted in FIG. 17 shows hand indentation 108 integral to hand indentation sheet 110, it is intended to fall within the scope of this disclosure that hand indentations 108 may be separate, individual components, individually attached to garment right chest 88 and garment left chest 90.

FIG. 19 is a front view of upper body garment 2 with a hand indentation 108 installed on its garment right stomach 88 adjacent garment front opening 12, and a hand indentation 108 installed on its garment left stomach 90 adjacent garment front opening 12, with its digits pointing diagonally towards garment front opening 12. A passenger 70 may put his hands around the stomach of driver 60 in conventional fashion, and then place the palm side of his hands into respective hand indentations 108. With hands securely placed within hand indentations 108, passenger 70 enjoys a more secure grip on garment right stomach 88 and garment left stomach 90, and by extension, a more secure grip on driver 60. While the embodiment depicted in FIG. 17 shows hand indentation 108 integral to hand indentation sheet 110, it is intended to fall within the scope of this disclosure that hand indentations 108 may be separate, individual components, individually attached to garment right stomach 88 and garment left stomach 90.

In the preferred embodiment, divot 82, divot sheet 80, hand indentation 108, and hand indentation sheet 110 were made of rubber, synthetic, plastic, textile, or any other appropriate material. Divots 82 and hand indentations 108 were attached to upper body garment 2 by means of stitching, adhesive, hook and loop material, or any other appropriate fastening means.

While a preferred embodiment of the invention has been illustrated herein, it is to be understood that changes and variations may be made by those skilled in the art without departing from the spirit of the appending claims.

DRAWING ITEM INDEX

2 upper body garment
4 garment sleeve
6 garment trunk
8 garment left side
10 garment right side
12 garment front opening
14 garment zipper
20 left pocket
122 left pocket mouth
24 pocket angle
26 thumb lobe
28 major lobe
30 pocket roof
32 pocket floor
34 non-slip material
36 finger lobe
37 finger lobe distal end
40 right pocket
42 right pocket mouth
60 driver
70 passenger
72 passenger left arm
74 passenger right arm
80 divot sheet
82 divot
84 garment right chest
86 garment left chest
88 garment right stomach
90 garment left stomach
100 life preserver
102 life preserver right front
104 life preserver left front
106 life preserver front opening
108 hand indentation
110 hand indentation sheet

We claim:

1. A garment with underarm externally accessible breast pockets for wearing by a driver of a tandem-seating vehicle comprising an upper body garment comprising a left garment sleeve and a right garment sleeve depending from a garment trunk, a garment left side extending downwardly from an intersection of said garment left arm with said garment trunk, a garment right side extending downwardly from an intersection of said garment right arm with said garment trunk, at least one pocket mouth disposed directly below one said arm, a pocket disposed within said upper body garment corresponding to each said at least one pocket mouth, said at least one pocket mouth and each said pocket being sized to admit a passenger hand and arm, a pocket floor in each said pocket, and a plurality of divots disposed in said pocket floor at an end of said pocket opposite said pocket mouth, said divots being smooth, uninterrupted concave indentations sized, shaped and located so as to admit human fingertips.

2. The garment with underarm externally accessible breast pockets of claim 1 comprising four said divots in each said pocket, said divots being arrayed so that a resting human hand's fingertips will fit into said divots.

3. The garment with underarm externally accessible breast pockets of claim 1 wherein each said pocket terminates in a mitten shape comprising a thumb lobe and a major lobe, said thumb lobe being sized to admit a passenger thumb, said major lobe being sized to admit passenger fingers, and said divots being disposed at an end of said major lobe opposite said pocket mouth.

4. The garment with underarm externally accessible breast pockets of claim 1 wherein each said pocket terminates in a glove shape comprising a thumb lobe and a plurality of finger lobes, said thumb lobe being sized to admit a passenger thumb, each said finger lobe being sized to admit a passenger finger, one said divot being disposed in each finger lobe distal end.

5. An upper body garment for wearing by a driver of a tandem-seating vehicle comprising a garment trunk, a garment opening in a front of said garment trunk, and a plurality of divots disposed on said garment trunk adjacent said garment front opening, said divots being smooth, uninterrupted concave indentations sized, shaped and located so as to admit human fingertips.

6. The upper body garment of claim 5 wherein said upper body garment comprises a chest, and said divots are disposed on a chest of said upper body garment.

7. The upper body garment of claim 6 wherein four said divots are disposed on a right side of said chest and arrayed so that a resting human hand's fingertips will fit into the garment right chest divots, and four said divots are disposed on a left side of said chest and arrayed so that a resting human hand's fingertips will fit into the garment right chest divots.

8. The upper body garment of claim 5 wherein said garment comprises a stomach, and said divots are disposed on a stomach of said upper body garment.

9. The upper body garment of claim 8 wherein four said divots are disposed on a right side of said stomach and arrayed so that a resting human hand's fingertips will fit into the garment right stomach divots, and four said divots are disposed on a left side of said stomach and arrayed so that a resting human hand's fingertips will fit into the garment right stomach divots.

10. An upper body garment for wearing by a driver of a tandem-seating vehicle comprising a garment trunk, a garment opening in a front of said garment trunk, and at least one hand indentation disposed on said garment trunk adjacent said garment front opening, said hand indentation being sized, shaped and located so as to admit a front side of a human hand palm, fingers and thumb.

11. The upper body garment of claim 10 wherein said upper body garment comprises an upper body garment chest, and said at least one hand indentation is disposed on said upper body garment chest.

12. The upper body garment of claim 11 wherein a first said hand indentation is disposed on a right side of said garment chest and positioned so its digits are pointing at said upper garment front opening, and a second said hand indentation is disposed on a left side of said garment chest and positioned so its digits are pointing at said upper garment front opening.

13. The upper body garment of claim 10 wherein said upper body garment comprises an upper body garment stomach, and said at least one hand indentation is disposed on said upper body garment stomach.

14. The upper body garment of claim 13 wherein a first said hand indentation is disposed on a right side of said upper body garment stomach and positioned so its digits are pointing diagonally at said upper garment front opening, and a second said hand indentation is disposed on a left side of said upper body garment stomach and positioned so its digits are pointing diagonally at said upper garment front opening.

15. The upper body garment of claim 10 wherein each said hand indentation is integrally formed as part of a hand indentation sheet, each said hand indentation sheet being attached to said upper body garment.

16. The garment with underarm externally accessible breast pockets of claim 1 wherein a group of said divots are integrally formed as part of a divot sheet, each said divot sheet being attached to said upper body garment.

17. An upper body garment style life preserver for wearing by a driver of a tandem-seating vehicle comprising a life preserver front and a life preserver front opening, and a plurality of divots formed into said life preserver front adjacent said life preserver front opening, said divots being smooth, uninterrupted concave indentations sized, shaped and located so as to admit human fingertips.

18. The life preserver of claim 17 wherein said life preserver comprises a life preserver chest, and said divots are disposed on said life preserver chest.

19. The life preserver of claim 18 wherein four said divots are disposed on a rights side of said life preserver chest and arrayed so that a resting human hand's fingertips will fit into the life preserver right chest divots, and four said divots are disposed on a left side of said life preserver chest and arrayed so that a resting human hand's fingertips will fit into the life preserver right chest divots.

20. The life preserver of claim 17 wherein said life preserver comprises a life preserver stomach, and said divots are disposed on said life preserver stomach.

21. The life preserver of claim 20 wherein four said divots are disposed on a right side of said life preserver stomach and arrayed so that a resting human hand's fingertips will fit into the life preserver right stomach divots, and four said divots are disposed on a left side of said life preserver stomach and arrayed so that a resting human hand's fingertips will fit into the life preserver right stomach divots.

22. An upper body garment style life preserver for wearing by a driver of a tandem-seating vehicle comprising a life preserver front and a life preserver front opening, and at least one hand indentation disposed on said life preserver front adjacent said life preserver front opening, said hand indentation being sized, shaped and located so as to admit a front side of a human hand palm, fingers and thumb.

23. The life preserver of claim 22 wherein said life preserver comprises a life preserver chest, and said at least one hand indentation is disposed on said life preserver chest.

24. The life preserver of claim 23 wherein a first said hand indentation is disposed on a right side of said life preserver chest and positioned so its digits are pointing at said upper garment front opening, and a second said hand indentation is disposed on a left side of said life preserver chest and positioned so its digits are pointing at said upper garment front opening.

25. The life preserver of claim 22 wherein said life preserver comprises a life preserver stomach, and said at least one hand indentation is disposed said life preserver stomach.

26. The life preserver of claim 25 wherein a first said hand indentation is disposed on a right side of said life preserver stomach and positioned so its digits are pointing diagonally at said life preserver front opening, and a second said hand indentation is disposed on a left side of said life preserver stomach and positioned so its digits are pointing diagonally at said life preserver front opening.

27. A method of wearing a garment with underarm externally accessible breast pockets while the garment is being worn by a tandem driver, and a tandem passenger is riding behind the driver, comprising the steps of:

A. Providing an upper body garment having a left garment sleeve and a right garment sleeve extending from a garment trunk, a garment left side extending downwardly from an intersection of said left garment sleeve with said garment trunk, a garment right side extending downwardly from an intersection of said right garment sleeve with said garment trunk, at least one pocket communicating with an exterior of said garment through a pocket mouth, said pocket comprising a pocket floor, a plurality of divots disposed in a pocket floor associated with each said pocket, said pocket mouth being disposed along one said garment side directly below one said garment sleeve;

B. A driver donning said upper body garment;

C. Positioning said passenger behind said driver; and

D. Said passenger inserting at least one passenger arm and hand through said pocket mouth into said at least one pocket, and inserting a passenger fingertip into each said divot.

28. The method of use for a garment with underarm externally accessible breast pockets of claim 20 comprising the further steps of providing a mitten shape termination comprising a thumb lobe and a major lobe for each said at least one pocket, each said major lobe comprising a major lobe floor, and a plurality of divots disposed on each said pocket floor, each said divot being associated with a corresponding said major lobe, and said passenger inserting a passenger fingertip into each said divot.

29. The method of use for a garment with underarm externally accessible breast pockets of claim 27 comprising the further steps of providing a glove shape termination comprising a thumb lobe and a plurality of finger lobes for each said at least one pocket and a divot at a finger lobe distal end associated with each said finger lobe, and said passenger inserting a passenger fingertip into each said divot.

30. A method of wearing an upper body garment while the garment is being worn by a tandem driver, and a tandem passenger is riding behind the driver, comprising the steps of:

A. Providing an upper body garment comprising a garment trunk, a garment opening in a front of said garment trunk, and a plurality of divots disposed on said garment trunk adjacent said garment front opening, said divots being sized, shaped and located so as to admit human fingertips;

B. A driver donning said upper body garment;

C. Positioning said passenger behind said driver; and

D. Said passenger placing at least one passenger arm and hand around said driver, and inserting a passenger fingertip into each said divot.

31. A method of wearing an upper body garment while the garment is being worn by a tandem driver, and a tandem passenger is riding behind the driver, comprising the steps of:

A. Providing an upper body garment comprising a garment trunk, a garment opening in a front of said garment trunk, and at least one hand indentation disposed on a front of said upper body garment trunk adjacent said garment front opening, said hand indentation being sized, shaped and located so as to admit the palm side of a human hand;

B. A driver donning said upper body garment;

C. Positioning said passenger behind said driver; and

D. Said passenger placing at least one passenger arm and hand around said driver, and placing a passenger hand into each said hand indentation.

* * * * *

UNITED STATES PATENT AND TRADEMARK OFFICE

CERTIFICATE OF CORRECTION

PATENT NO. : 7,966,667 B2
APPLICATION NO. : 12/231036
DATED : June 28, 2011
INVENTOR(S) : Jodi Tomlinson and Kevin Cutlip It is certified that error appears in the above-identified patent and that said Letters Patent is hereby corrected as shown below:

| | | |
|---|---|---|
| Col. 5 Line 15: | Is: "...90 degrees i 20 degrees..." | Should Be: "...90 degrees ± 20 degrees..." |
| Col. 7 Line 44: | Is: "...that divots may..." | Should Be: "...that divots 82 may..." |
| Col. 9 Line 55: | Is: "122 left pocket mouth" | Should Be: "22 left pocket mouth" |
| Col. 10 Line 22: | Is: "...garment left arm..." | Should Be: "...garment left sleeve..." |
| Col. 10 Line 24: | Is: "...garment right arm..." | Should Be: "...garment right sleeve..." |
| Col. 12 Line 28: | Is: "...disposed said life..." | Should Be: "...disposed on said life..." |
| Col. 12 Line 60: | Is: "...of claim 20..." | Should Be: "...of claim 27..." |

Signed and Sealed this
Thirteenth Day of September, 2011

David J. Kappos

David J. Kappos
*Director of the United States Patent and Trademark Office*